10/8/85 OR 4,545,868

United States Patent [19]

Martin et al.

[11] Patent Number: 4,545,868

[45] Date of Patent: Oct. 8, 1985

[54] PALLADIUM PLATING

[75] Inventors: James L. Martin, Merrick; John E. McCaskie, North Merrick; Michael P. Toben, Oceanside, all of N.Y.

[73] Assignee: LeaRonal, Inc., Freeport, N.Y.

[21] Appl. No.: 639,401

[22] Filed: Aug. 10, 1984

Related U.S. Application Data

[63] Continuation of Ser. No. 549,375, Nov. 7, 1983, abandoned, which is a continuation of Ser. No. 309,096, Oct. 6, 1981, abandoned.

[51] Int. Cl.[4] ..... C25D 3/50

[52] U.S. Cl. ..... 204/47

[58] Field of Search ..... 204/47, 44.6, 109

[56] References Cited

U.S. PATENT DOCUMENTS

| | | | |
|---|---|---|---|
| 330,149 | 11/1885 | Pilet et al. | 204/47 |
| 3,637,474 | 1/1972 | Zuntini et al. | 204/47 |
| 3,925,170 | 12/1975 | Skomoroski et al. | 204/43 N |
| 3,972,787 | 8/1976 | Nobel et al. | 204/47 |
| 4,093,520 | 6/1978 | Koontz | 204/15 |
| 4,098,656 | 7/1978 | Deuber | 204/47 |
| 4,242,180 | 12/1980 | Heppner et al. | 204/43 N |
| 4,297,179 | 10/1981 | Skomoroski | 204/47 |
| 4,299,670 | 11/1981 | Yahalom | 204/29 |
| 4,316,779 | 2/1982 | Yahalom | 204/29 |
| 4,339,311 | 7/1982 | Branik | 204/47 |
| 4,392,921 | 7/1983 | Miscioscio et al. | 204/47 |
| 4,451,336 | 5/1984 | Vangaever | 204/47 |

FOREIGN PATENT DOCUMENTS

| | | | |
|---|---|---|---|
| 20020 | 12/1980 | European Pat. Off. | 204/47 |
| 2057503 | 4/1981 | United Kingdom | 204/47 |
| 2090866 | 7/1982 | United Kingdom | 204/47 |
| 379675 | 7/1973 | U.S.S.R. | 204/43 N |
| 433245 | 11/1974 | U.S.S.R. | 204/43 N |

*Primary Examiner*—G. L. Kaplan

*Attorney, Agent, or Firm*—Pennie & Edmonds

[57] ABSTRACT

The invention relates to a method for high speed palladium electroplating by immersing the object to be plated in an ammoniacal solution of a palladium tetra-amino complex ion, palladium metal in a concentration of at least 10 g/l, and at least one carbonate or phosphate anion in a concentration of more than about 7.5 g/l and less than about 150 g/l. The solution has a pH of between about 7 and 9 and is free of quaternized pyridinium brightening agents. Palladium is plated into a substrate with high speed plating equipment which provides sufficient agitation, and current densities of 100 ASF and above to produce lustrous crack free deposits.

15 Claims, 6 Drawing Figures

Figure 1:
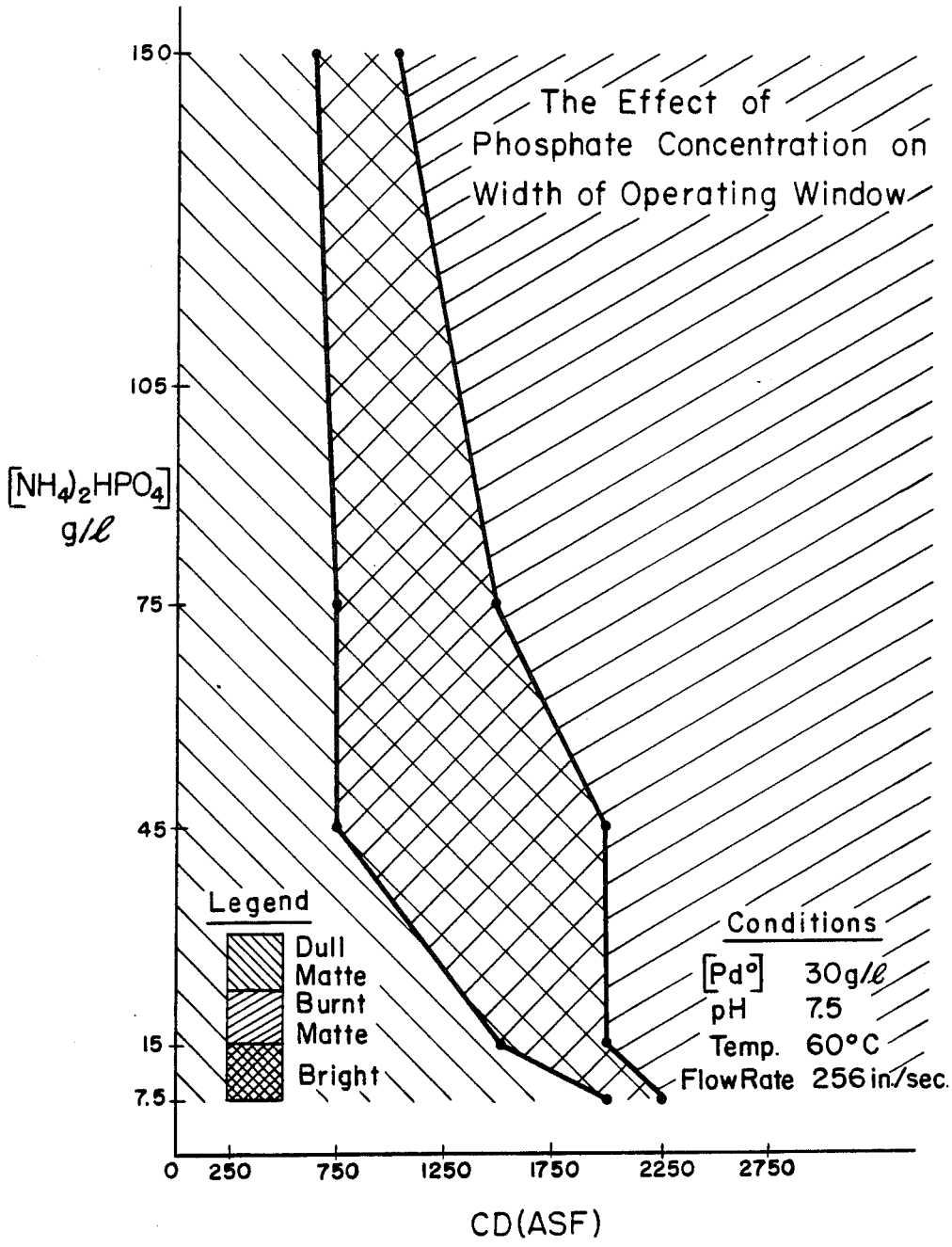

The Effect of Palladium Concentration on Width of Operating Window

The Effect of Temperature on Width of Operating Window

The Effect of Temperature on Width of Operating Window

The Effect of Agitation on Width of Operating Window

PALLADIUM PLATING

This is a continuation of application Ser. No. 549,375, filed Nov. 7, 1983 abandoned, which in turn is a continuation of Ser. No. 309,096, filed Oct. 6, 1981, abandoned.

FIELD OF THE INVENTION

The invention relates to the electroplating of palladium, particularly with high speed plating equipment, in which the plating solution contains phosphate or carbonate ions.

BACKGROUND OF THE INVENTION

The dramatic increase in the price of gold over the past several years has given rise to new methods and equipment in the electroplating field and attempts to use substitute metals such as palladium through selective plating. Specialized plating equipment such as described, for example, in U.S. Pat. Nos. 3,723,283 and 3,819,502, and others of a similar nature, utilize chemical or mechanical masks which limit the metal deposits to the specific required area while leaving other areas free of the metal. The use of equipment of this type makes possible a reduction in the amount of metal deposited by a factor of 10 or above compared with equipment and methods utilizing overall plating techniques and results in a like reduction in the cost of the electroplated item produced.

The use of such plating process requires very high speed plating and high speed requires high current densities preferably above 100 ASF. A discussion of some of the problems and advantages of high speed plating is found in U.S. Pat. No. 3,879,269.

Attempts have been made to plate palladium from high speed plating equipment with various baths, however, the deposits are either burned and matte gray or they are bright to semi-bright and highly stressed and exhibit surface microcracks which are visible only under the microscope at high power. These cracks can be visible in the deposit right out of the plating bath or they become visible later or after the deposit has been permitted to stand at room temperature for about a day or so. Much has been written about these cracks and it is generally attributed to the co-deposition of hydrogen with palladium, and after the hydrogen is emitted from the deposit cracks will appear. The industry desires to have palladium deposits that are crack-free at usable current densities in high speed plating. The current densities required for high speed plating in today's technology range from about 100 to 2,000 ASF and higher. High speed plating equipment employs the jet plating principle where the solution is sprayed out onto the surface being plated with a jet stream, to provide very vigorous agitation. It is also possible to supply vigorous agitation without the jet stream, but by moving the solution very rapidly past the part being plated through the use of a pump and/or by moving the parts rapidly through the solution.

Prior art palladium plating solutions are exemplified by U.S. Pat. Nos. 3,972,787 and 4,092,225, U.S. published patent application B450,499 and Russian Pat. No. 354,010.

U.S. Pat. No. 3,972,787 discloses a number of palladium plating baths. The first four specific baths are disclosed as having a current density range from 0.1 to 40 ASF except for Example 5 which was 0.1 to 50 ASF.

All of these baths are unsuitable for high speed plating. The patent also discloses that at 20 g/l palladium it is possible to plate at 500 to 1,000 ASF at 50° C., but without the brighteners the panel is dull gray above 4 ASF.

The Russian patent discloses palladium chloride, ammonia ions and ammonia phosphate at a pH of 6.1 and 6.7. The usable current density range of these solutions is 6 to 8 ASF, and they cannot be used in high speed plating.

The published application No. B450,499 uses palladium ammonium chloride and free ammonia at a pH of at least 8.8. These baths contain no phosphate or carbonate anions.

U.S. Pat. No. 4,092,225 adds palladium as $Pd(NH)_3)_2(NO_2)_2$ and tetrapotassium pyrophosphate to form a bath at a pH of 8.5 to 11 and discloses that the solutions are suitable for rack plating at 2–50 ASF.

DISCLOSURE OF THE INVENTION

This invention involves the discovery that palladium plating solutions containing phosphates or carbonates can be formulated without quaternized pyridinium brightening agents and operated under certain plating conditions to produce acceptable crack free lustrous palladium deposits within specific high current density ranges suitable for high speed plating. The invention is predicated upon fairly well defined ranges of solution ingredient concentrations as well as operating conditions. The object is to obtain an acceptable lustrous deposit which is crack free over a practical high current density range suitable for use in high speed plating, such as high speed jet plating equipment and cathode agitation systems.

When plating palladium from any known bath that applicants are aware of, the current density can be raised stepwise until a point is reached above which typical burning of the deposit will take place. A burnt palladium deposit has a powdery dark gray appearance that is almost black and totally matte. Our invention consists of the discovery of a specific set of operating parameters and solution parameters at high current densities to produce lustrous crack free palladium deposits where one would otherwise expect the deposit to be burnt or the deposit cracked.

In high speed jet stream plating, agitation is generally quite violent. Velocities of 200 to 250 inches per second are not uncommon. Due to these high velocities, by way of a jet stream, the actual velocities at the cathode can vary considerably and therefore it is necessary to have a fairly wide current density range for practical commercial purposes.

Figure 5:
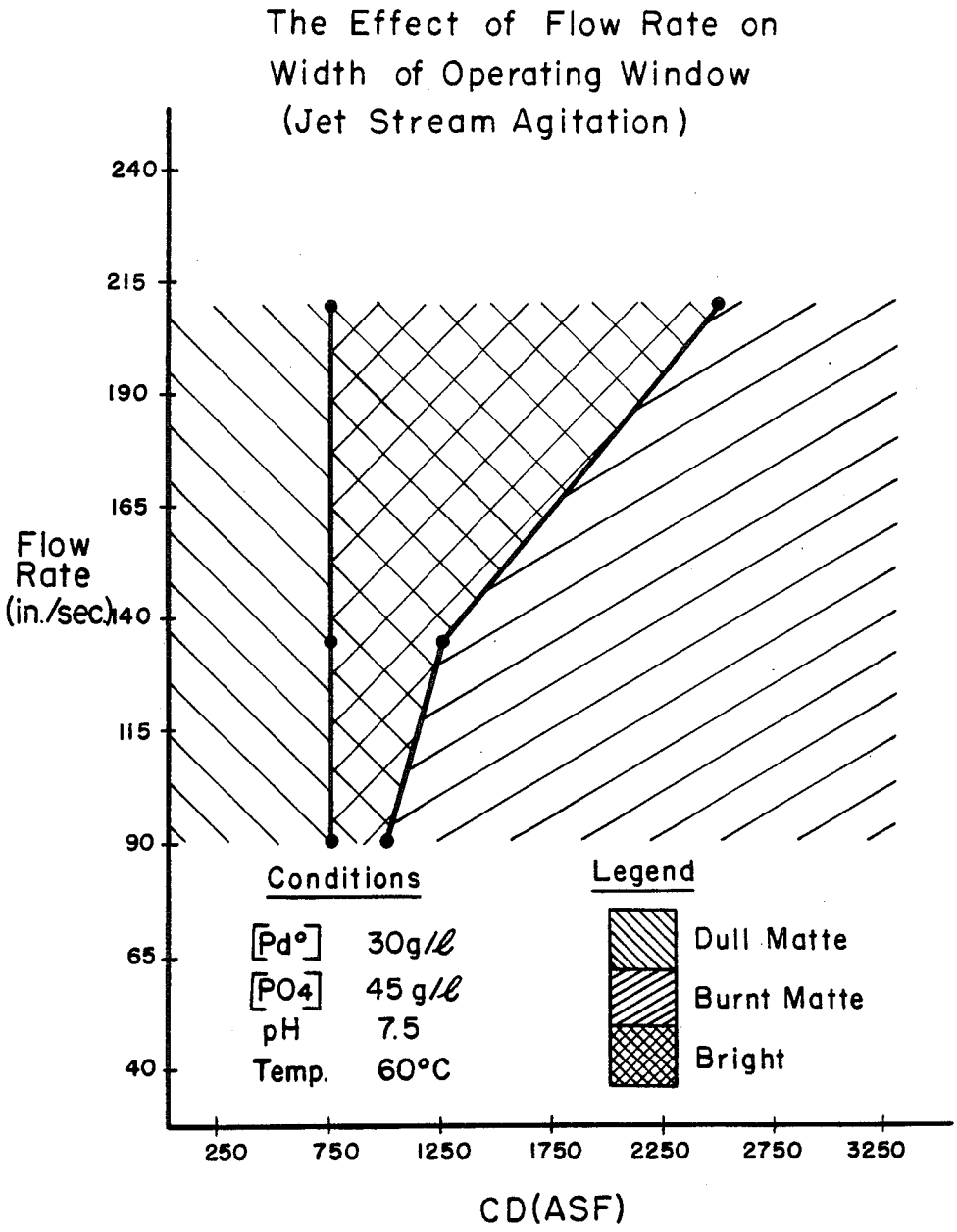

The velocities reported herein and in FIG. 5 are obtained by measuring flow to the jets in cubic inches per second and dividing this figure by the total jet area measured in square inches. The cathode surface being plated is also larger than the jet stream impinging upon it; therefore, the velocity figures do not represent velocity impingement over the entire cathode surface nor what actually takes place on the cathode surface. The extent of agitation at the cathode depends generally on the geometry of the system, such as the size of the cathode, the particular mask being employed, and the distance between the jet outlets and the cathodes etc., as will be apparent to those skilled in the art. Thus, there will generally be large variations in agitation over the surface of the cathode, and this is the reason why wide current density is desired. The experiments reflected in the drawings were made using a fairly large specific area (about ¼" square) which is one of the more difficult cathode areas to plate requiring a fairly wide current density window or delta because of large variations of agitation at the cathode. With smaller cathode areas, a more narrow window or delta can be tolerated, such as a delta of about 200 ASF. Delta as used herein means the range in which acceptable deposits can be obtained. For example, in FIG. 1 at 45 g/l of ammonium phosphate the acceptable range is from 750 ASF to 2000 ASF and the delta or difference is 1250 ASF, and at 75 g/l the delta is 750 ASF.

A delta of at least 750 ASF is generally desirable and a delta of 500 ASF would generally be acceptable depending on the plating speeds and type of cathode being plated. These deltas lend diversification to the solutions to permit plating of large cathode areas as well as small areas which might only require an ASF delta of about 200 without changing solutions. Many objects to be plated also have variable current density requirements, again requiring a fairly wide current density window. The current density range selected will also depend on the current density requirements of the article to be plated. Some articles may require a range from 750 to 2000 ASF while others 500 to 1500 ASF, while other articles can even be plated, such as small round dots, with a delta of 200 ASF. With cathode rod agitation equipment utilizing cathode movement, it is also advantageous to have as wide a window as possible. At an agitation rate of about 3 inches per second at 100 ASF this window, for lustrous crack free deposits, should advantageously have a delta of at least about 37 ASF.

U.S. Pat. No. 3,972,787 discloses the use of certain brighteners in baths containing palladium chloride and solutions 4 and 5 include phosphates. The patent also states that without the brighteners, the panels are dull gray above 4 ASF. Contrary to this disclosure, the applicants have found that when solution 4 is plated at a current density between 250 and 500 ASF and solution 5 at a current density between 200–300 ASF without the brighteners, the deposits are crack free and the luster is fair. Below the lower current densities, the deposits are dull gray and above the higher current densitites they are burnt. These solutions have current density deltas of 250 and 100 and are not too practical for use in plating with high speed jet plating equipment. Plating from solutions 4 and 5 without the brighteners with cathode movement equipment gave no useful current density range and bright deposit could not be obtained. A current density delta of at least about 50 when operating at a current density of 100 ASF is almost essential for practical high speed cathode movement palladium plating. The patent also discloses that when the palladium metal content of the solution of the examples is increased to 20 g/l using $2\times10^{-4}$ mols/liter of the brightener, bright deposits can be obtained from 500 to 1000 ASF. Such deposits, however, will exhibit surface microcracks and be unacceptable.

The applicants have discovered that by adjusting the palladium metal content to about 10 g/l and above, maintaining the phosphate content above 7.5 g/l and below 150 g/l (calculated as ammonium phosphate), and maintaining the pH to between about 7 and 9, that these solutions can be successfully employed in high speed plating equipment at current densities above 100 ASF to produce lustrous crack free deposits so long as adequate agitation or the flow rate is maintained.

FIGS. 1 through 6 graphically depict certain of the operating windows with the variations in the phosphate content, the palladium content, the temperature, flow rate (jet stream agitation) and cathode rod agitation.

As shown in FIG. 1, an operating window exists above 7.5 g/l of ammonium phosphate up to 150 g/l. At zero ammonium phosphate there was no operating window and the deposits were dull over the entire current density range. The operating window broadens and a very acceptable broad operating window is found at 45 g/l of ammonium phosphate, and the most acceptable range for the phosphate content, under the standard conditions set for the experiment depicted in FIG. 1, is from about 80 g/l of ammonium phosphate to about 20 g/l. At 75 g/l the deposits were somewhat brighter. At 150 g/l the current density range was about 650 to 800 ASF and, although the deposits were brighter, cracking took place in the deposit.

Although ammonium phosphate was used in these experiments, all phosphate compounds tried to date were found to be similarly operable so long as they were soluble in the bath. Potassium pyrophosphate can also be used, for example. The presence of sufficient phosphate or carbonate anion is the important factor and the concentration of other phosphates will have to be adjusted to give equivalent anion concentration with respect to the experiment using ammonium phosphate. Any solution soluble carbonate or bicarbonate compound such as sodium or potassium carbonate can be used to supply the carbonate ion.

Although there is no drawing depicting variations in the operating windows based on the pH of the plating solution, the operating pH range is between about 7 and below 9. When utilizing a solution containing 30 g/l of palladium, 45 g/l of ammonium phosphate, a temperature of 60° C. and a flow rate of approximately 208 inches per second, there was no operating range or window at all at pH of 6.5. At a pH of 9 the operating window narrowed to about 250 ASF and ammonia driven off. Using these same conditions but lowering the temperature of the bath to 40° C. an operating window of 500–1500 ASF is obtained. This shows that by variation of any one of the important parameters a usable current density range for high speed plating can be obtained or the range can be moved in one direction or another.

Figure 2:
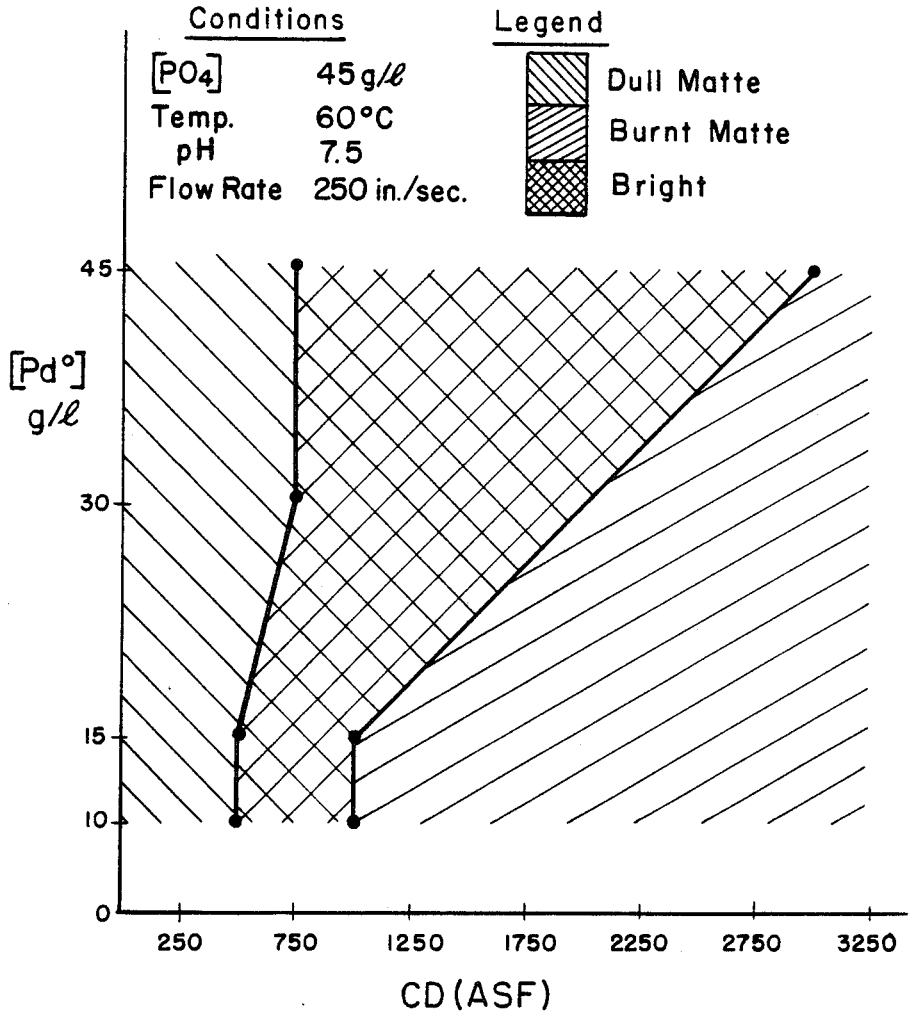

FIG. 2 shows that variations in the operating window by altering the palladium metal content. At a pH of 7.5 and a flow rate of about 208 inches per second and a palladium content of 7.5 g/l, there was no operating window at all at temperatures of 40° C., 50° C. and 60° C. It is apparent from the graph that amounts of palladium metal in excess of 45 g/l can be used, but such large amounts would be unnecessary.

Figure 3:
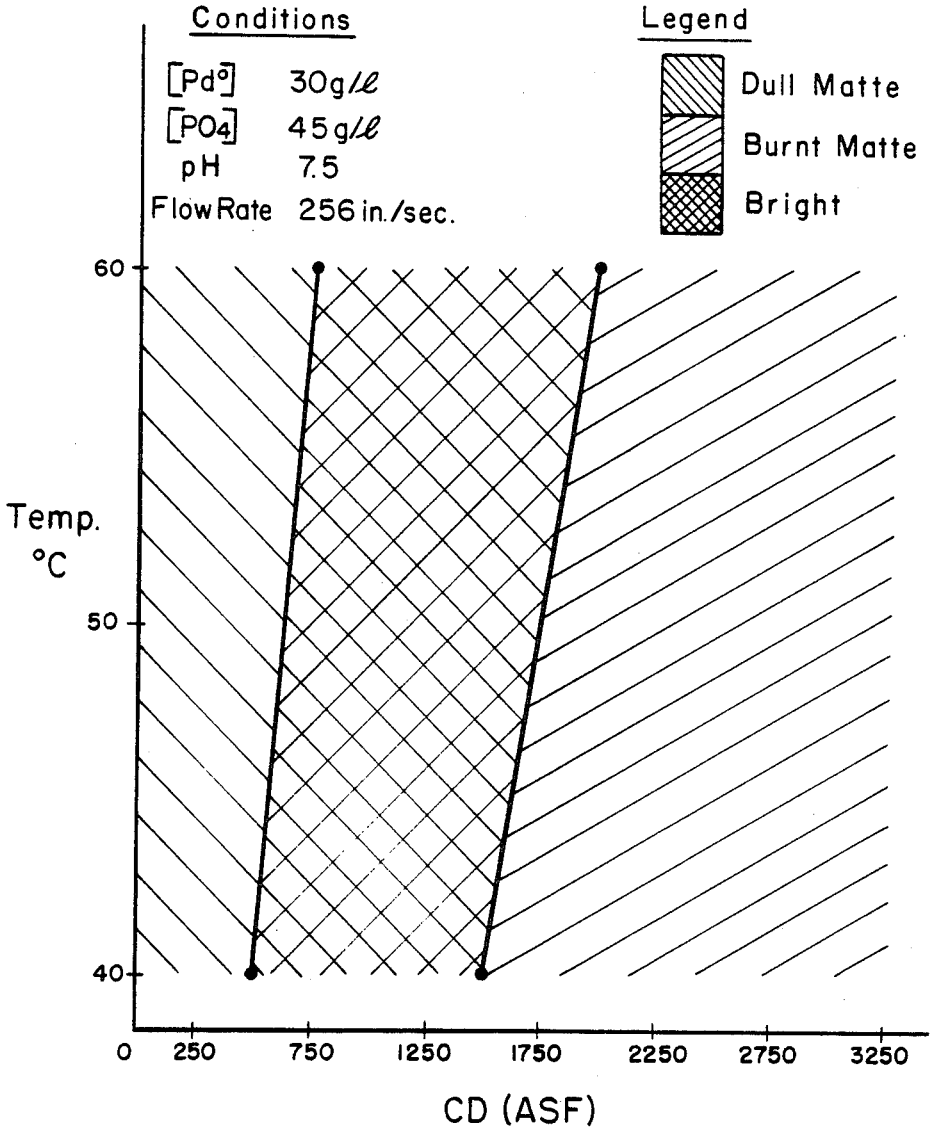
Figure 4:
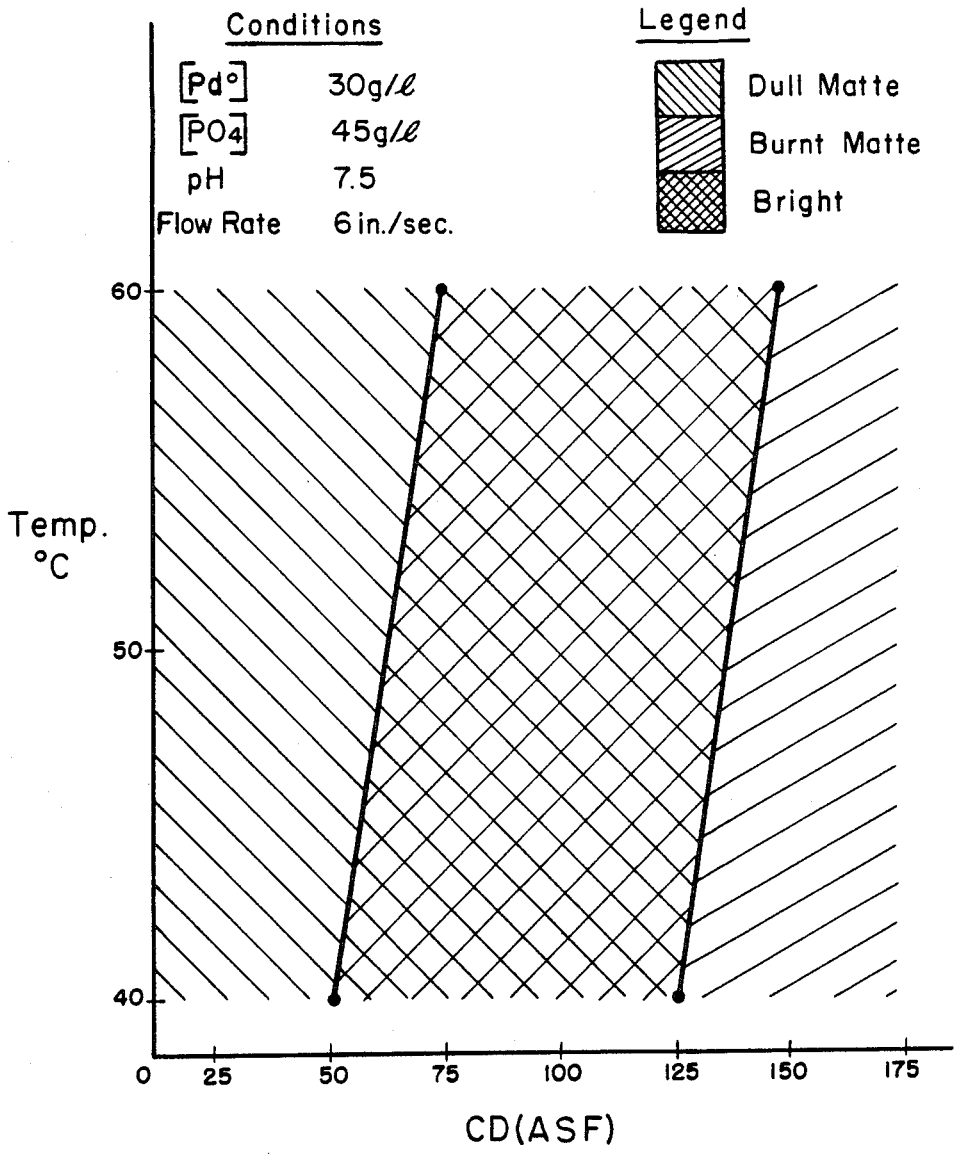

FIGS. 3 and 4 show that there is little effect on the width of the current density window with temperature change under the set conditions of the experiments. The graphs do show that temperature changes can be advantageously employed to shift the lower and upper limits of the window. Temperature does have a profound effect however upon pH change. With the compositions shown in FIG. 3 at a pH of 9, the solution was not useable for high speed plating, however, the same composition at a temperature of 40° C. gave an operating window of 500–1500 ASF. Below 500 ASF the deposits were unuseable and above 1500 ASF the deposits were burnt.

Figure 6:
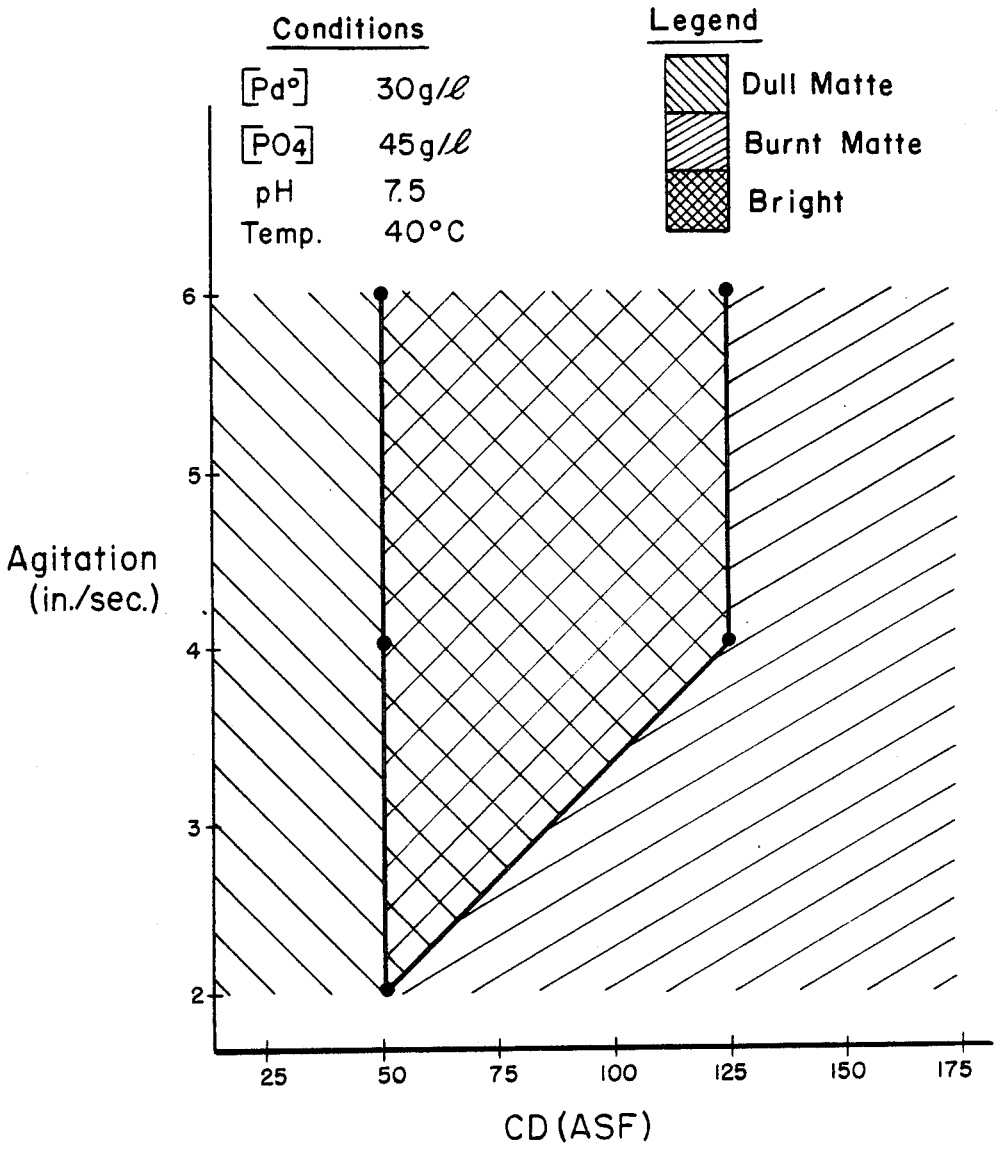

FIG. 5 shows the current density variations due to flow rate with jet stream high speed equipment while FIG. 6 shows the current density windows using cathode rod agitation under the conditions noted.

The data contained in FIGS. 1, 2, 3 and 5 were obtained with high speed jet stream plating equipment under the conditions shown and with cathode agitation equipment in FIGS. 4 and 6. Experiments such as those shown in FIGS. 1, 2 and 3 will show substantially the same results with cathode agitation but not the same numbers. The windows or current density delta will be smaller, but this is acceptable as noted above with cathode agitation and other high speed plating process.

It must be borne in mind that the graphs are only illustrative of the invention being based on one specific set of conditions with only one variable. For example, the operating window of FIG. 1 will not be the same if the set conditions are changed to a palladium content of 20 or 45 g/l. In such a case, it may be advantageous to change the pH, the flow rate or the phosphate or carbonate content to obtain the optimum operating window, and this can readily be accomplished by routine experimentation.

The palladium metal can be supplied to the solution by any compound capable of forming a palladium tetraamino complexion. Examples of such compounds include: $Pd(NH_3)_4^{++}x$ where x is an anion such as chloride, bromide, acetate, sulfate and nitrate. The addition of palladium metal as palladium tetraamino chloride is perferred.

We claim:

1. A method of plating palladium with high speed plating equipment to produce lustrous crack-free palladium deposits which comprises forming an ammoniacal palladium plating solution containing a phosphate and/or carbonate anion at a concentration above about 7.5 g/l and below about 150 g/l, said solution being free of quaternized pyridinium brightening agents; adjusting the pH, the palladium content, the phosphate and/or carbonate concentration, and the rate of agitation of the solution so that the solution is capable of being plated at a current density range delta of at least about 200 ASF when plating with high speed jet stream equipment at an agitation rate above 120 inches per second or a current density range delta of above about 37 ASF when plating with cathode agitation equipment at an agitation of above about 3 inches per second, and plating the palladium from such solutions with high speed jet stream equipment or cathode movement equipment at an ASF above 50.

2. The method according to claim 1 in which the carbonate anion is supplied by any solution soluble carbonate or bicarbonate compound.

3. The method according to claim 1 in which the phosphate anion is supplied by ammonium phosphate or potassium pyrophosphate.

4. The method according to claim 1 in which the delta for jet stream agitation is about 500 ASF.

5. The method according to claim 1 wherein the palladium content is at least about 10 g/l of palladium metal.

6. A method for high speed palladium electroplating which comprises (a) immersing a substrate to be plated into an ammoniacal solution of a palladium tetra amino complex that contains a palladium metal concentration of at least about 10 g/l, a pH of between about 7 and 9 and at least one phosphate or carbonate anion in a concentration of greater than about 7.5 g/l and less than about 150 g/l, said solution being free of quaternized pyridinium brightening agents, and (b) agitating the solution at a sufficient rate so that the solution is capable of being plated at a current density range delta of at least about 200 ASF when plating with high speed jet stream equipment and above about 25 ASF when plating with cathode agitation while plating palladium onto the substrate with high speed plating equipment at 100 ASF and above; said method producing lustrous, crack-free palladium deposits on said substrates.

7. The method according to claim 6 in which the carbonate anion is supplied by any solution soluble carbonate or bicarbonate compound.

8. The method according to claim 6 in which the phosphate anion is supplied by ammonium phosphate or potassium pyrophosphate.

9. The method according to claim 6 in which the delta for jet stream agitation is above about 500 ASF.

10. A method for plating palladium with high speed plating equipment to produce lustrous crack-free palladium deposits which comprises forming an ammoniacal palladium plating solution containing a phosphate and/or carbonate anion at a concentration above about 7.5 g/l and below about 150 g/l, said solution being free of quaternized pyridinium brightening agents; adjusting the pH, the palladium content, and the phosphate and/or carbonate concentration; and agitating the solution at a sufficient rate so that the solution is capable of being plated at a current density range delta of at least about 200 ASF when plating with high speed jet stream equipment and above about 25 ASF when plating with cathode agitation so as to produce lustrous, crack-free palladium deposits.

11. The method according to claim 10 wherein the agitation of the solution is above about 120 inches per second when plating with high speed jet stream equipment or above about 2 inches per second when plating with cathode agitation.

12. The method according to claim 11 in which the delta for jet stream agitation is about 500 ASF.

13. The method according to claim 10 in which the carbonate anion is supplied by any solution soluble carbonate or bicarbonate compound.

14. The method according to claim 10 in which the phosphate anion is supplied by ammonium phosphate or potassium pyrophosphate.

15. The method according to claim 10 wherein the palladium content is at least about 10 g/l of palladium metal.

* * * * *

UNITED STATES PATENT AND TRADEMARK OFFICE

CERTIFICATE OF CORRECTION

PATENT NO. : 4,545,868

DATED : October 8, 1985

INVENTOR(S) : James L. Martin, John E. McCaskie and Michael P. Toben

It is certified that error appears in the above-identified patent and that said Letters Patent is hereby corrected as shown below:

Abstract line 6: change "anion" to --compound--.

Claim 1, col. 5, line 38: change "anion" to --compound--.

Claim 2, col. 5, line 56: change "anion" to --compound--.

Claim 3, col. 5, line 59: change "anion" to --compound--.

Claim 6, col. 6, line 10: change "anion" to --compound--.

Claim 7, col. 6, line 24: change "anion" to --compound--.

Claim 8, col. 6, line 27: change "anion" to --compound--.

Claim 10, col. 6, line 35: change "anion" to --compound -.

Claim 13, col. 6, line 54: change "anion" to --compound--.

Claim 14, col. 6, line 57: change "anion" to --compound--.

Signed and Sealed this

*Twenty-ninth* Day of *April 1986*

[SEAL]

*Attest:*

DONALD J. QUIGG

*Attesting Officer*

*Commissioner of Patents and Trademarks*